US007764905B2

(12) United States Patent
Ohta et al.

(10) Patent No.: US 7,764,905 B2
(45) Date of Patent: Jul. 27, 2010

(54) ASSIST MEMBERS FOR AN OPENABLE STRUCTURE OF AN IMAGE FORMING APPARATUS

(75) Inventors: Yoshihide Ohta, Kanagawa (JP); Shigeo Nanno, Kyoto (JP); Toshikane Nishii, Osaka (JP); Takuji Takahashi, Kanagawa (JP); Takamasa Shiraki, Kanagawa (JP); Takaaki Hagihara, Kanagawa (JP); Takayuki Andoh, Kanagawa (JP)

(73) Assignee: Ricoh, Company, Ltd., Tokyo (JP)

( * ) Notice: Subject to any disclaimer, the term of this patent is extended or adjusted under 35 U.S.C. 154(b) by 222 days.

(21) Appl. No.: 11/987,609

(22) Filed: Dec. 3, 2007

(65) Prior Publication Data

US 2008/0131164 A1 Jun. 5, 2008

(30) Foreign Application Priority Data

Dec. 5, 2006 (JP) ..... 2006-328219

(51) Int. Cl.
*G03G 15/00* (2006.01)
*G03G 21/16* (2006.01)

(52) U.S. Cl. ..... 399/125

(58) Field of Classification Search ..... 399/124, 399/125

See application file for complete search history.

(56) References Cited

U.S. PATENT DOCUMENTS

| | | | | |
|---|---|---|---|---|
| 6,690,901 | B2 | 2/2004 | Katsuyama et al. | |
| 7,388,593 | B2 * | 6/2008 | Fukuda | 399/125 X |
| 7,421,228 | B2 * | 9/2008 | Tomura | 399/125 X |
| 7,433,629 | B2 * | 10/2008 | Tomatsu | 399/125 |

FOREIGN PATENT DOCUMENTS

| | | |
|---|---|---|
| JP | 04-053988 | 5/1992 |
| JP | 04-143771 | 5/1992 |
| JP | 05-045948 | 2/1993 |
| JP | 05-197225 | 8/1993 |
| JP | 5-330713 | 12/1993 |
| JP | 08-099749 | 4/1996 |
| JP | 2706860 | 10/1997 |
| JP | 11-038714 | 2/1999 |
| JP | 2001-022143 | 1/2001 |
| JP | 3176411 | 4/2001 |
| JP | 2001-343880 | 12/2001 |
| JP | 2002-361975 | 12/2002 |
| JP | 2002-365864 | 12/2002 |
| JP | 2003-058019 | 2/2003 |
| JP | 3418308 | 4/2003 |
| JP | 3430868 | 5/2003 |
| JP | 3446928 | 7/2003 |

(Continued)

*Primary Examiner*—Sandra L Brase
(74) *Attorney, Agent, or Firm*—Harness, Dickey & Pierce, P.L.C.

(57) ABSTRACT

An image forming apparatus includes a first housing, a rotary shaft attached to the first housing, a second housing supported by the first housing, and first and second open-close assist members. The second housing is configured to open and close with respect to the first housing by rotating around the rotary shaft. The first and the second open-close assist members are directly attached to the first housing and the second housing and configured to assist opening and closing the second housing. The first and the second open-close assist members share assistance in opening and closing the second housing.

19 Claims, 5 Drawing Sheets

FOREIGN PATENT DOCUMENTS

| | | |
|---|---|---|
| JP | 3477026 | 9/2003 |
| JP | 2004-264500 | 9/2004 |
| JP | 2004-279691 | 10/2004 |
| JP | 2004-354832 | 12/2004 |
| JP | 2005-020374 | 1/2005 |
| JP | 2005-167801 | 6/2005 |
| JP | 2005-182032 | 7/2005 |
| JP | 2005-242267 | 9/2005 |
| JP | 2005-301154 | 10/2005 |
| JP | 2006-065188 | 3/2006 |
| JP | 2006-089165 | 4/2006 |
| JP | 2006-119236 | 5/2006 |
| JP | 2006-119474 | 5/2006 |
| JP | 2006-184530 | 7/2006 |
| JP | 3830091 | 7/2006 |
| JP | 2006-208910 | 8/2006 |
| JP | 2006-227064 | 8/2006 |
| JP | 2006-240848 | 9/2006 |
| JP | 2006-276620 | 10/2006 |
| JP | 2006-279877 | 10/2006 |
| JP | 2006-330356 | 12/2006 |

* cited by examiner

ASSIST MEMBERS FOR AN OPENABLE STRUCTURE OF AN IMAGE FORMING APPARATUS

CROSS-REFERENCE TO RELATED APPLICATIONS

This patent specification claims priority to Japanese Patent Application No. JP2006-328219, filed on Dec. 5, 2006 in the Japan Patent Office, the entire contents of which are hereby incorporated by reference herein.

BACKGROUND OF THE INVENTION

1. Field of the Invention

The present invention generally relates to an image forming apparatus such as a copier, a printer, a facsimile machine, etc., and more particularly to an image forming apparatus including a structure openable and closable with respect to a main body.

2. Discussion of the Background Art

There are image forming apparatuses such copiers, printers, facsimile machines, etc., that include an exterior cover that can be opened to expose an interior of a main body of the image forming apparatus. In cases of image forming apparatuses including a scanner, a pressure plate or an automatic document feeder (ADF) included therein is typically openable with respect to a main body of the image forming apparatus or a scanner part.

Further, in recent years, there are an increasing number of image forming apparatuses that include a sheet discharge space inside a housing thereof. In some cases, such a sheet discharge space is located at an upper part on which a scanner is provided. The upper part is configured to be openable with respect to a main body, together with the scanner.

When such an openable body includes a scanner and an ADF, the openable body is heavy and a large force is required to open and close the entire openable body. Further, if the openable body closes quickly, a user's hand might get caught between the heavy openable body and the main body.

Therefore, there are image forming apparatuses including an open-close assist mechanism provided between an openable body and a main body, to reduce the force needed to open and close the openable body and prevent damage to the main body and injury to users. Such open-close assist mechanism typically uses a damper, a spring, etc, and is also referred to as a shock absorber or a bias mechanism.

One related-art example of an image forming apparatus includes a main body and an openable body including a scanner part. The openable body opens and closes with respect to the main body by rotating around a rotary shaft provided at one end thereof. The image forming apparatus further includes a shock absorber provided at the other end opposite to the rotary shaft and a bias mechanism to bias the openable body in a open direction.

Another related-art example of an image forming apparatus includes a scanner and an ADF that open and close with respect to a main body by sliding. In this case, a damper, etc., is not necessary.

However, when the entire openable body is heavy, the open-close assist mechanism thereof is relatively large, which makes it difficult to make an image forming apparatus more compact.

SUMMARY OF THE INVENTION

In view of the foregoing, in one illustrative embodiment of the present invention, an image forming apparatus includes a first housing, a rotary shaft attached to the first housing, a second housing supported by the first housing, and first and second open-close assist members. The second housing is configured to open and close with respect to the first housing by rotating around the rotary shaft. The first and the second open-close assist members are directly attached to the first housing and the second housing and configured to assist opening and closing the second housing. Thus, the first and the second open-close assist members share assistance in opening and closing the second housing.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
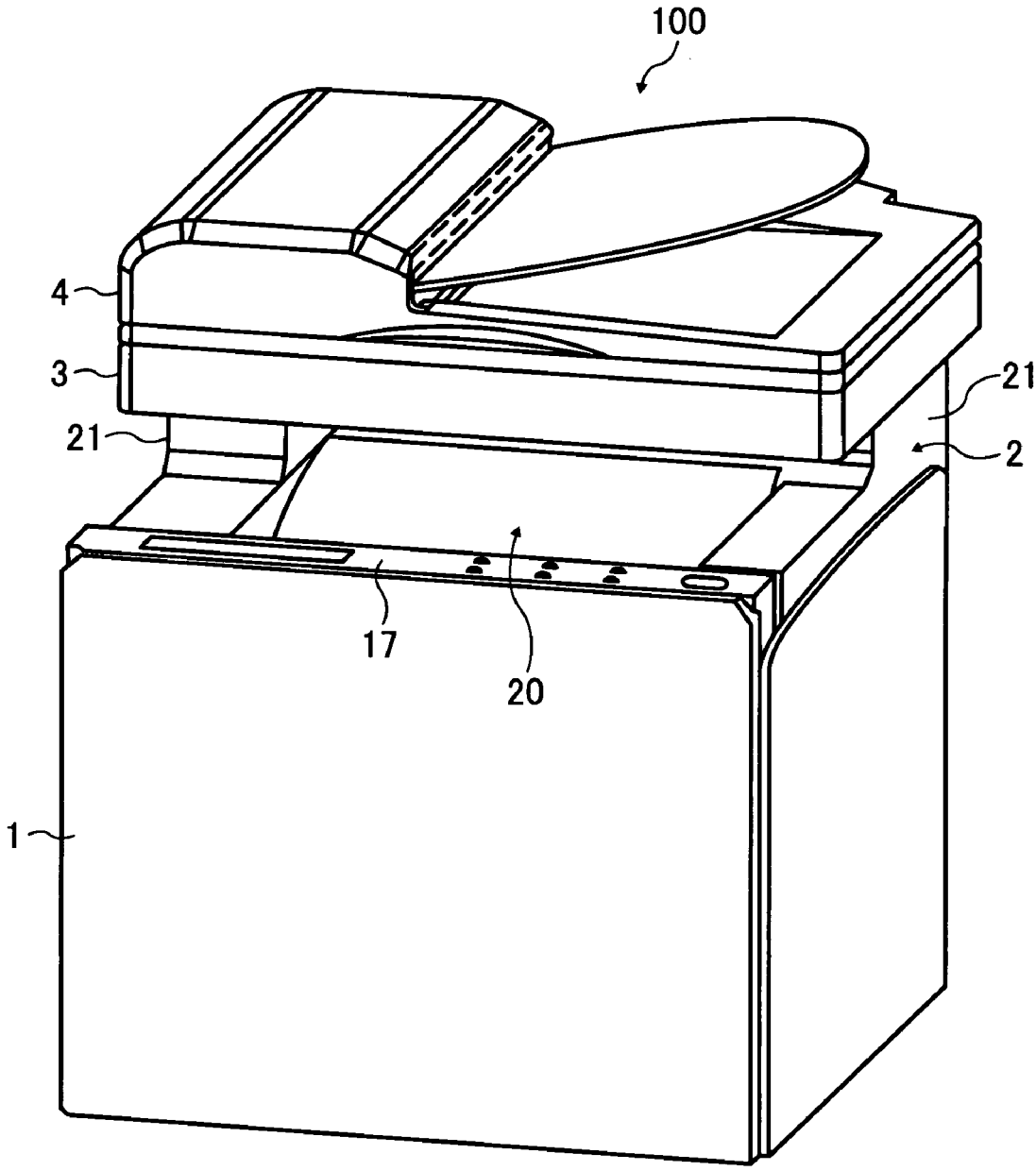
FIG. 1 is a perspective view illustrating an example of an image forming apparatus according to an example embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like references numerals designate identical or corresponding parts throughout the several views thereof, and particularly to FIG. 1, an example of an image forming apparatus according to an example embodiment of the present invention is described.

FIG. 1 is an external view of an image forming apparatus 100, which is a digital multi-function machine including an image reading device. The image forming apparatus 100 includes an apparatus body 1 as a first housing and an upper unit 2 as a second housing located over the apparatus body 1. The upper unit 2 is configured to open and close with respect to the apparatus body 1, and supports a scanner 3 and an automatic document feeder (ADF) 4 located over the apparatus body 1. An operation panel 17 is provided on an upper surface of a front side of the apparatus body 1. The upper unit 2 includes a pair of bases 21, which support the scanner 3 and the ADF 4, forming a discharge space 20 between the apparatus body 1 and the scanner 3. Thus, the image forming apparatus 100 includes a sheet discharge space inside a housing thereof.

Figure 2:
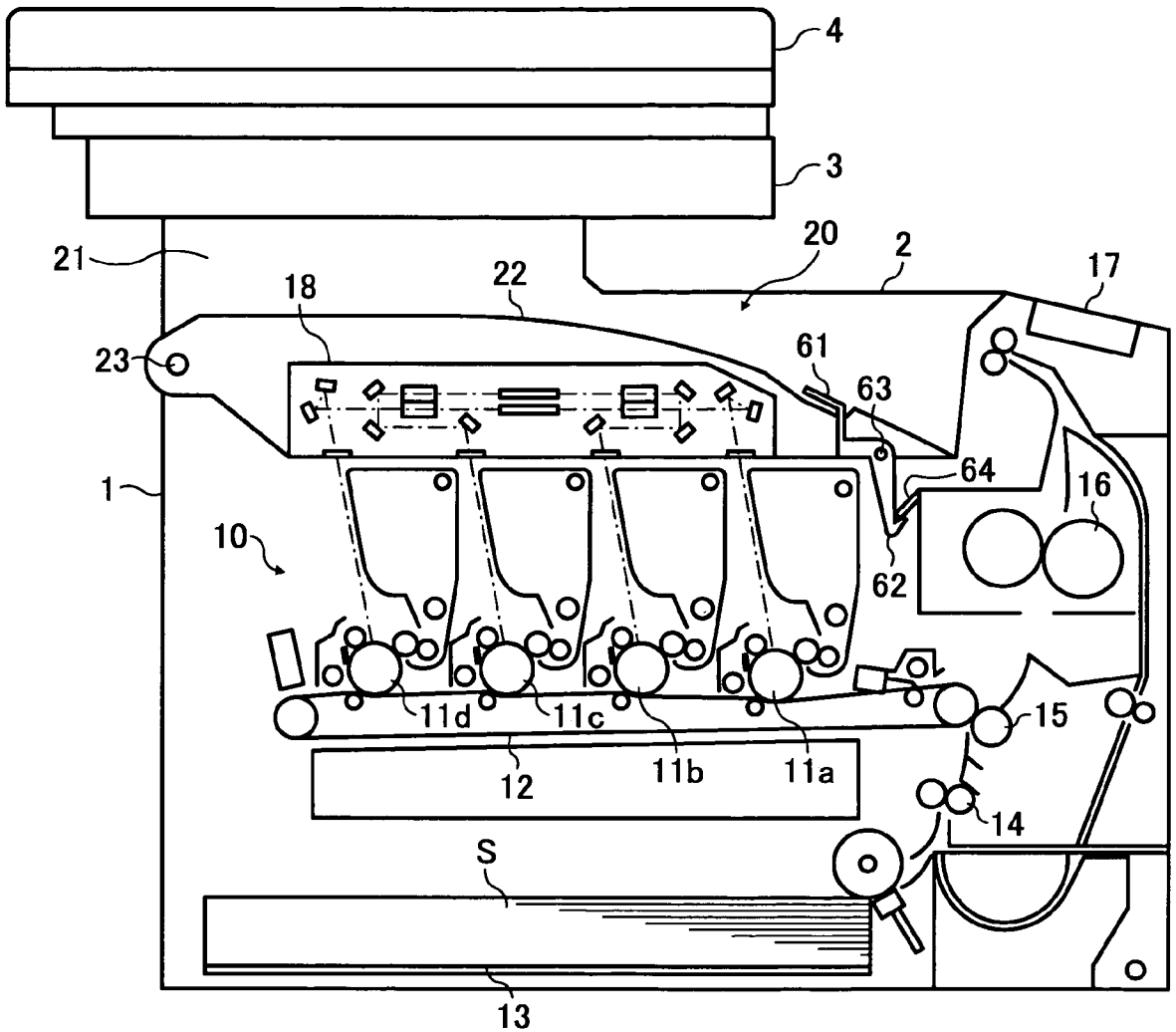
FIG. 2 is a cross section diagram illustrates an inner configuration of the image forming apparatus from a side.

FIG. 2 illustrates a cross section inside the image forming apparatus 100 in an anteroposterior direction. As illustrated in FIG. 2, the apparatus body 1 includes an image forming part 10, a sheet feeder located beneath the image forming part 10, and a laser writing part 18 located above the image forming part 10. The sheet feeder includes a sheet cassette 13 containing sheets S, etc. A discharge tray 22 is provided on an upper surface of an exterior of the upper unit 2. The apparatus body 1 further includes a pair of registration rollers 14, a secondary transfer roller 15 as a secondary transferer, and a fixer 16 along a sheet transport path.

The upper unit 2 is rotatable upward around a rotary shaft 23. In the present embodiment, when the upper unit 2 rotates upward (open), the laser writing part 18 moves together with the upper unit 2 and an area above the image forming part 10 is exposed, because the laser writing part 18 is supported by the upper unit 2. The upper unit 2 further includes a lever 61 including a hook 62 rotatable around an axis 63. The hook 62 prevents the upper unit 2 from rotating upward by being engaged with an engagement part 64 provided on the apparatus body 1. When the lever 61 is pulled upward to disengage the hook 62 from the engagement part 64, the upper unit 2 is able to open.

The image forming part 10 is configured as a tandem type and able to form color images. The image forming part 10 includes photoreceptor drums 11*a*, 11*b*, 11*c*, and 11*d* as image carriers, on each of which either a black, yellow, cyan, or magenta image is formed, arranged along an upper side of an intermediate transfer belt 12. It is to be noted that each of the photoreceptor drums 11*a*, 11*b*, 11*c*, and 11*d* is hereinafter referred to as the photoreceptor drum 11 when discrimination is not required, because configurations thereof are similar to each other excepting only the color of the toner images formed thereon. Inside the intermediate transfer belt 12, primary transferers are located to face one of the photoreceptor drums 11 via the intermediate transfer belt 12.

Around each photoreceptor drum 11, components for performing electronographic processes, such as a charger, a developing device, a cleaner, etc., are provided. In the present embodiment, each photoreceptor 11 and those components related thereto are integrated into a process cartridge (image forming unit). That is, the apparatus body 1 includes four detachably mountable process cartridges.

A sequence of color copying (image forming processes) performed by the digital image forming apparatus 100 is briefly described below.

When a user places an original document on a document table of the ADF 4 or a contact glass of the scanner 3 and inputs a command to start copying on the control panel 17, the scanner 3 reads full color image information on the original document. It is to be noted that, when the image forming apparatus 100 is used as a printer, the image forming apparatus 100 receives image information from an external computer connected thereto via a LAN, etc. When used as a facsimile machine, the image forming apparatus 100 receives image information via communication lines.

In each image forming unit, while the photoreceptor drum 11 is driven by a driving source, not shown, and rotates clockwise in FIG. 2, the charger charges a surface of the photoreceptor drum 11. The laser writing part 18 directs a scanning light onto the charged surface of the photoreceptor drum 11, thus forming an electrostatic latent image thereon. The full color information read by the scanner 3 is separated into single color information of yellow, magenta, cyan, and black. In this writing process, the surface of each photoreceptor drum 11 is exposed according to one of the yellow, magenta, cyan, and black single image information. The developing device develops the electrostatic latent image with one of yellow, magenta, cyan, and black toner.

The intermediate transfer belt 12 is driven and rotated counterclockwise in FIG. 2. The primary transferers transfer respective toner images from the photoreceptor drums 11 and superimpose the toner images one on another on the intermediate transfer belt 12, thus forming a full color toner image thereon.

It is to be noted that the image forming apparatus 100 can form monochrome, bicolor, and tricolor images by using one, two, or three of the image forming units, respectively. In monochrome printing, the black image forming unit is used.

After each toner image is primarily transferred, the cleaner removes toner remaining on the surface of each photoreceptor drum 11, and then a discharger, not shown, initialize a surface potential thereon as preparation for next image forming.

Along with the processes described above, a sheet S is fed from the sheet cassette 13, and the registration rollers 14 forward the sheet S to a secondary transfer nip, which is between the intermediate transfer belt 12 and the secondary transfer roller 15. The secondary transfer roller 15 transfers the toner image on the intermediate transfer belt 12 onto the sheet S. The sheet S carrying the toner image is further sent to the fixer 16 including a fixing roller and a pressure roller forming a fixing nip therebetween by pressing against each other. While the sheet S passes through the fixing nip, the toner image is fused and fixed on the sheet S with heat and pressure. The sheet S on which the toner image is fixed is discharged onto the discharge tray 22 by a pair of discharge rollers, not shown.

Figure 3:
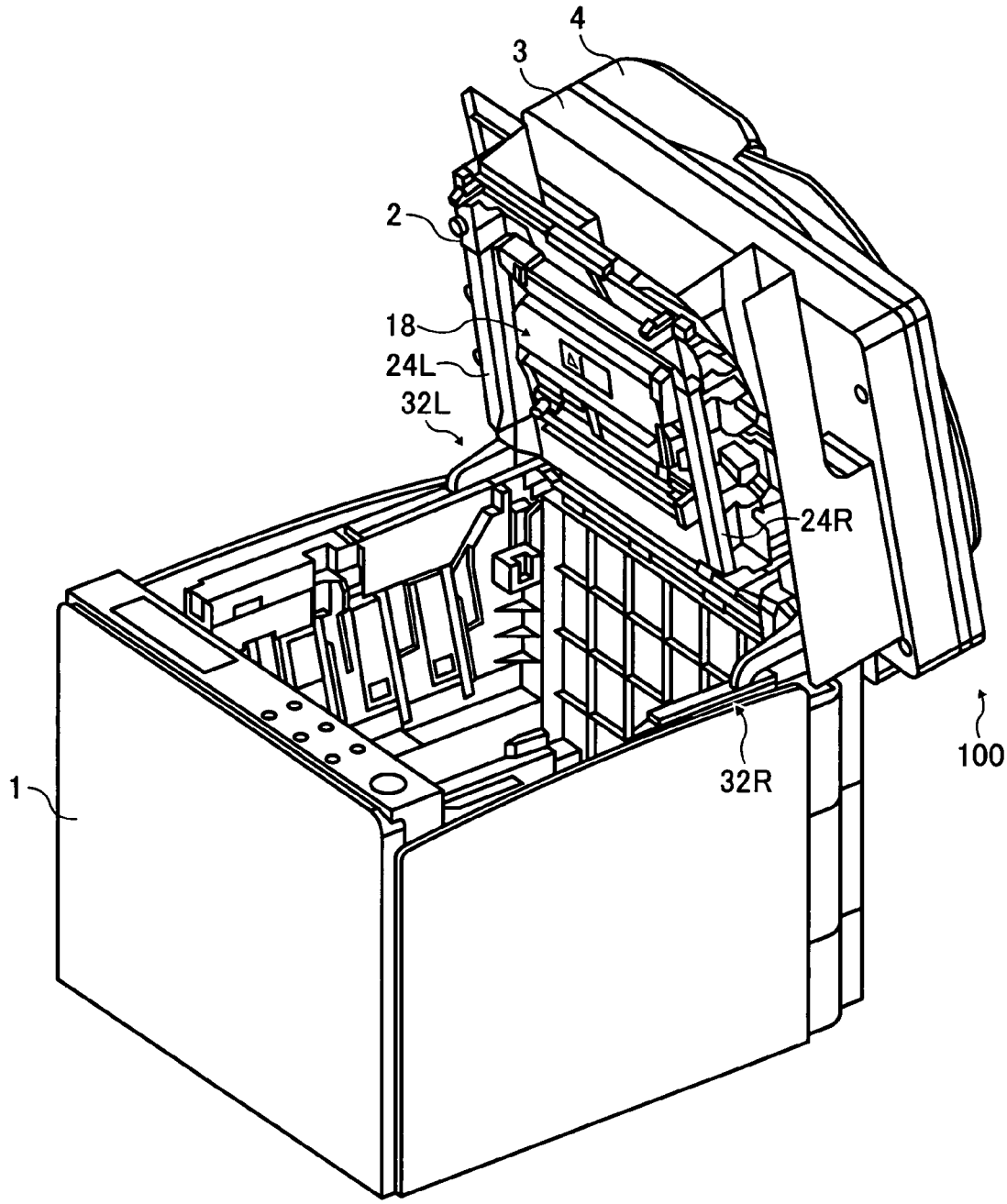
FIG. 3 is a perspective view illustrating a state of the image forming apparatus in which an upper unit is opened.

FIG. 3 illustrates a state in which the upper unit 2 is in an open position and the image forming part 10, etc., are removed from the apparatus body 1. As illustrated in FIG. 3, the image forming apparatus 100 further includes a pair of upper frames 24L and 24R that are rotatably supported by the rotary shaft 23 shown in FIG. 2, and a pair of second open-close assist members 32L and 32R. The laser writing part 18 is supported between the upper frames 24L and 24R.

In the present embodiment, because the upper unit 2 supports the scanner 3, the ADF 4, and the laser writing part 18, an entire openable body including the upper unit 2, the scanner 3, the ADF 4, and the laser writing part 18 is relatively heavy. Therefore, the image forming apparatus 100 further includes open-close assist mechanisms so that an excessively large force is not required to open and close the entire openable body, and the openable body does not fall so quickly as to hurt a user when the user release his/her hand therefrom. Further, the open-close assist mechanisms prevent or reduce damage to components of the image forming apparatus 100 caused by the impact of opening and closing the openable body. In the present embodiment, the image forming apparatus 100 is provided with two types of open-close assist mechanisms, as described below.

Figure 4:
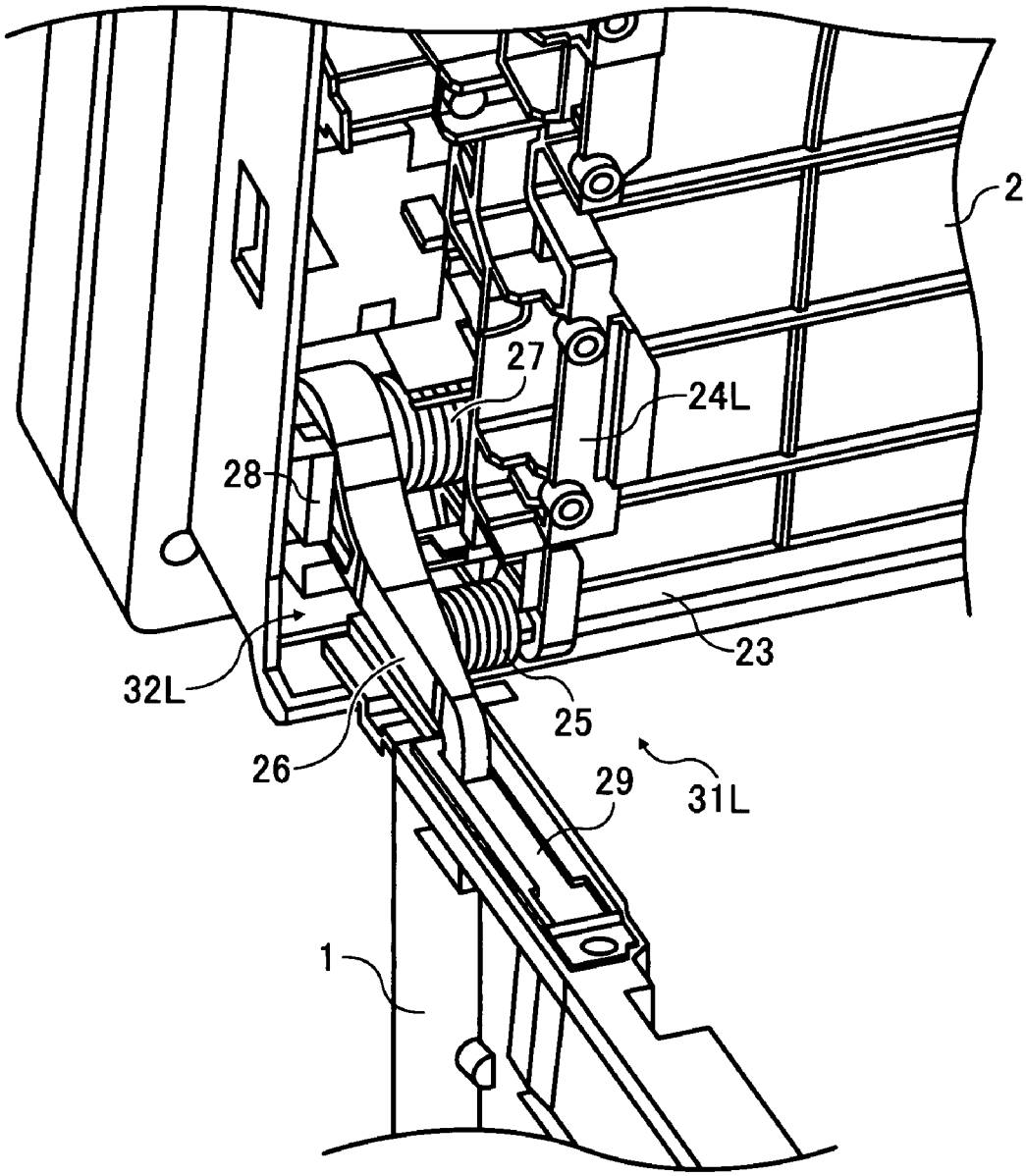
FIG. 4 is a partial enlarged perspective view illustrating first and second open-close assist members provided at a left side of the image forming apparatus.

FIG. 4 illustrates a left side of the apparatus body 1 and the upper unit 2. As shown in FIG. 4, the rotary shaft 23 is located at a back side of the apparatus body 1 and extends in a width direction thereof, and a torsion spring 25 is attached at a left end portion of the rotary shaft 23. The rotary shaft 23 and the torsion spring 25 form a first open-close assist member 31L. That is, the upper unit 2 is configured as an openable body fixed to the upper frames 24L and 24R, which is rotatably supported by the rotary shaft 23. The letters L and R indicate left and right, respectively. The second open-close assist member 32L includes a bias arm 26, a torsion spring 27, a torque limiter 28, and a slide rail 29.

Although FIG. 4 illustrates only the left side of the apparatus body 1 and the upper unit 2, it is to be noted that a first open-close assist member 31R having a configuration similar to or the same as that of the first open-close assist member 31L is provided at a right side thereof. The torsion springs 25 attached on both end portions of the rotary shaft 23 bias the upper unit 2 upward, that is, in an open direction.

In the first open-close assist member 31L, one end of the torsion spring 25 abuts a frame of the apparatus body 1, and the other end thereof is attached to the upper frame 24L. The torsion spring 25 is a spring to form a natural angle when the upper unit 2 is opened at an angle of 90 degrees or greater with the apparatus body 1 (open angle). At the right side, one end of the torsion spring 25 abuts the frame of the apparatus body 1, and the other end thereof is attached to the upper frame 24R. Thus, the torsion springs 25 of the left and right first open-close assist members 31L and 31R constantly bias the upper unit 2 in the open direction within a practical usage range. Further, because the bias of the torsion springs 25 is in proportion to the open angle of the upper unit 2, rough adjustment of the bias is easy.

Figure 5:
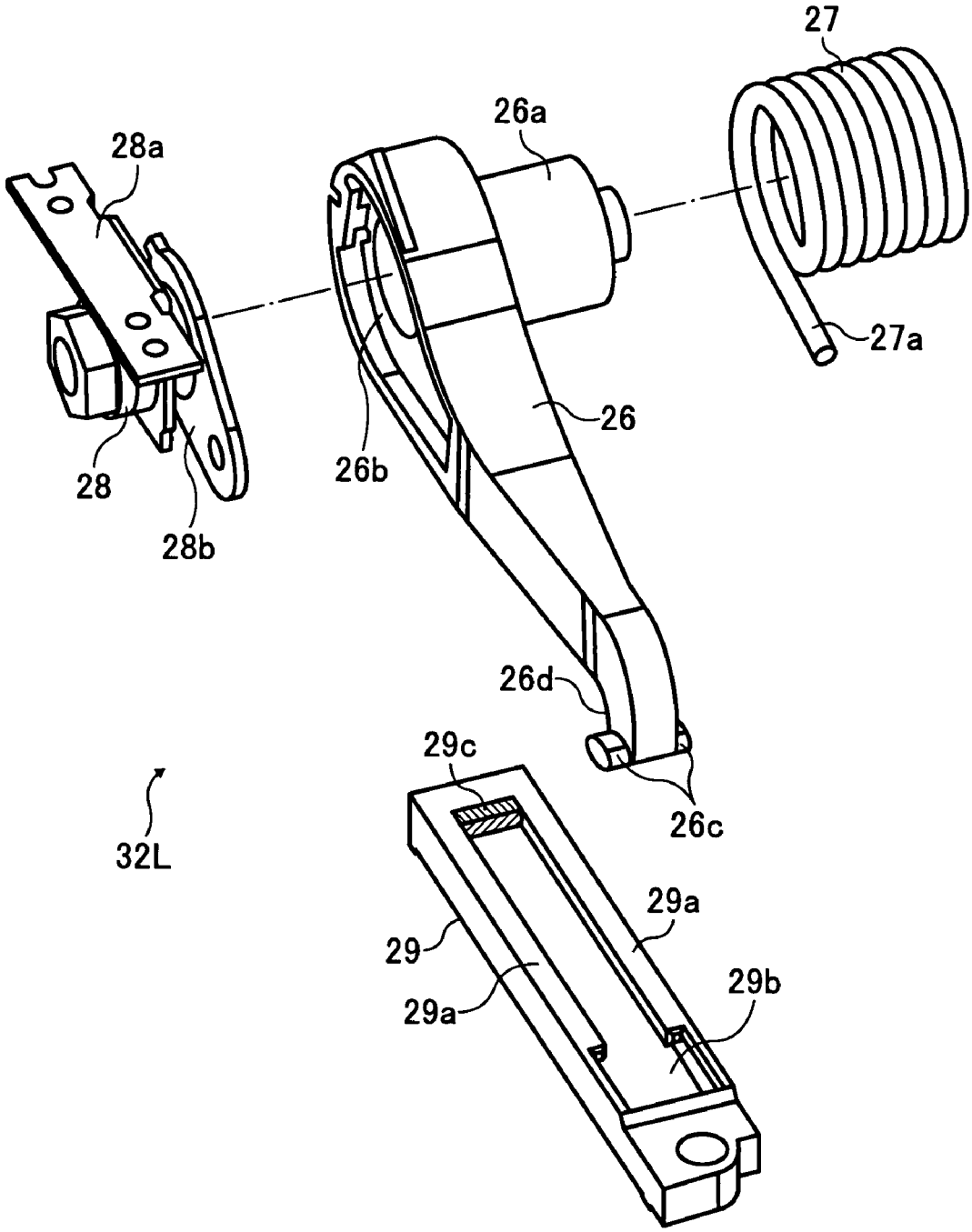
FIG. 5 is an exploded perspective view of the second open-close assist member.

The second open-close assist member 32L is further described blow, referring to FIGS. 4 and 5.

FIG. 5 is an exploded perspective view of the second open-close assist member 32L. The second open-close assist member 32L includes the bias arm 26, the torsion spring 27, the torque limiter 28, and the slide rail 29, as described above. The bias arm 26 is slidably supported by a frame of the upper unit 2 as shown in FIG. 4. As shown in FIG. 5, the bias arm 26 includes a rotary shaft 26*a* which the torsion spring 27 engages, and a torque limiter attachment part 26*b* to which the torque limiter 28 is attached so as to have a same axis as the rotation axis 26*a*, an engagement part 26*c*, and a contact part 26*d*. The engagement part 26*c* and the contact part 26*d* are located at an arm edge portion of the bias arm 26.

The torsion spring 27 includes a first end portion 27*a* and a second end portion, not shown. The tension spring 27 transmits a bias force to the bias arm 26 so as to rotate the bias arm 26 clockwise in FIG. 5, that is, a direction in which the arm edge portion moves downward, with the first end portion 27*a* contacted with the bias arm 26 and the second end portion contacted with the upper unit 2. The engagement part 26*c* projects in both sides of a shaft direction.

The torque limiter 28 includes attachment parts 28*a* and 28*b*. The torque limiter 28 is attached to the bias arm 26 so as to limit rotation of the upper unit 2, with the attachment part 28*a* attached to the upper unit 2 and the attachment part 28*b* attached to the torque limiter attachment part 26*b* of the bias arm 26.

The slide rail 29 is fixed on an upper surface of the frame of the apparatus body 1 and includes a pair of projections 29*a*, an opening 29*b*, and an elastic member 29*c*. The projections 29*a* are provided on an upper side of the slide rail 29 and extend in a longitudinal direction thereof, thus forming an engagement space thereunder that the engagement part 26*c* of the bias arm 26 slidably engages. The opening 29*b* is located at an end portion of the slide rail 29 in the longitudinal direction for leading the engagement part 26*c* into the engagement space. That is, the opening 29*b* is for engaging the engagement part 26*c* with the engagement space. The elastic member 29*c* is provided at an opposite end portion to the opening 29*b* where the contact part 26*d* of the bias arm 26 contacts. Examples of the elastic member 29*c* include rubber, sponge, compression spring, etc.

It is to be noted that, although FIG. 5 illustrates only the left second open-close assist member 32L, the left and right second open-close assist members 32L and 32R have a similar configuration, except for being symmetrical. The left second open-close assist member 32L attached to the apparatus body 1 and the upper unit 2 is illustrated in FIG. 4. Both the left and right second open-close assist members 32L and 32R are illustrated in FIG. 3.

When each of the second open-close assist members 32L and 32R configured as described above is attached to the apparatus body 1 and the upper unit 2, the engagement part 26*c* at the arm edge portion of the bias arm 26 engages the slide rail 29 and slides while being held by the slide rail 29, along with rotation of the bias arm 26, that is, rotation of the upper unit 2. Therefore, movement of the arm edge portion of the bias arm 26 caused by the rotation is not limited, and the bias arm attains a force in a direction perpendicular to a slide surface, that is, a bias force caused by the torsion spring 27, when friction is relatively small. Therefore, the second open-close assist members 32L and 32R assist opening and closing the upper unit 2 and reduce the force required to open and close the upper unit 2, without reducing operability thereof.

In the present embodiment, the second open-close assist members 32L and 32R attain an open-close assist mechanism having a small foot-print, because only the slide rail 29 is attached to the frame of the apparatus body 1 and a component whose width is relatively large is not attached thereto. Further, because in the upper unit 2, which is an openable body, a space in the base 21 is used effectively to attach the bias arm 26 and the torque limiter 28, a damper mechanism to limit movement of the openable body can be attained without damaging an appearance of the image forming apparatus 100 shown in FIG. 1. That is, the image forming apparatus 100 does not include a bar type damper, etc., that is visible from outside.

A force to limit rotation of the upper unit 2, which is given to the bias arm 26 by the torque limiter 28, works effectively even when an opening angle of the upper unit 2 is close to zero degree, at which a hand of a user might get caught and hurt if the upper unit 2 falls quickly, because the torsion spring 27 and the torque limiter 28 generates a rotation torque whose magnification equals a ratio of a distance between the engagement part 26*c* at the arm edge portion and the rotary shaft 23 shown in FIG. 4 to a length of the bias arm 26 when the upper unit 2 is at an almost closed state. Therefore, even relatively small torsion spring and torque limiter can limit rotation of the upper unit 2, thus attaining compactness and cost reduction.

Further, when the upper unit 2 is opened, the engagement part 26*c* of the bias arm 26 stops at an end portion of the back side of the apparatus body 1, and the bias arm 26 keeps the upper unit 2 from rotating further. Therefore, a maximum open angle of the upper unit 2 can be limited without providing another limiting member. In the present embodiment, the maximum open angle of the upper unit 2 is limited at a different position from the rotary shaft 23, that is, a position far from the rotary shaft 23, and thus a force that a limiting part receives is smaller compared with a case in which the maximum open angle of the upper unit 2 is limited at a position close to the rotary shaft 23, which is a rotation support point of the upper unit 2. Therefore, costs can be reduced, because the limiting part is not damaged even if molded material is used therein. It is to be noted that the bias arm 26 should be configured so as not to disengage from the slide rail 29 so as to limit the maximum open angle of the upper unit 2. In the present embodiment, an engagement part 26*c* projecting from the edge portion of the bias arm 26 in the shaft direction and the projections 29*a* provided at the upper side of the slide rail 29 prevent the bias arm 26 from coming out of the slide rail 29 and bias the upper unit 2 in a close direction.

Further, in the present embodiment, because the elastic member 29*c* is provided at the end portion of the back side of the slide rail 29 where the engagement part 26*c* of the bias arm 26 contacts, the impact of the contact part 26*d* of the bias arm 26 thereto can be absorbed. Therefore, operability in opening the upper unit 2 can be enhanced and damage to components can be prevented or reduced. Moreover, although rubber, sponge, compression spring, etc., may be used as the elastic member 29*c*, rubber is most effective in absorbing impact. Further, when the upper unit 2 is configured so that a center of gravity of the entire openable body including the upper unit 2, the writing part 18, scanner 3, and the ADF 4 passes a position vertically above the rotary shaft 23 while the upper unit 2 rotates from the closed state to the maximum open angle, the upper unit 2 starts to move by its own weight in the open direction. In such a case, because early braking is preferred, a compression spring is preferred as the elastic member 29*c*.

A brake mechanism when the center of gravity of the entire openable body passes a position vertically above the rotary shaft 23 while rotating in the open direction is further described below.

The upper unit 2 can be configured to be biased in the open direction around a closed angle (rotation start position) and in the close direction after the upper unit 2 passes a predetermined or given position, while rotating in the open direction, by setting the torsion springs 25 or the torsion springs 27 to be a natural angle while the upper unit 2 rotates in the open direction. In the present embodiment, the upper unit 2 is configured to be biased to reduce movement by its own weight. That is, the upper unit 2 is configured to be biased in the close direction after the upper unit 2 passes a position where the center of gravity of the entire openable body is vertically above the rotary shaft 23, at which the upper unit 2 starts self-weight movement.

It is to be noted that to attain a bias of the torsion spring 27 in the close direction, the bias arm 26 should be configured so as not to disengage from the slide rail 29 upward in a vertical direction. In the present embodiment, an engagement part 26*c* projecting from the edge portion of the bias arm 26 in the shaft direction and the projections 29*a* provided at the upper side of the slide rail 29 prevent the bias arm 26 from disengaging from the slide rail 29 and bias the upper unit 2 in the close direction.

Further, the engagement part 26*c* projects from the edge portion of the bias arm 26, and the opening 29*b* is provided on the end portion of the slide rail 29 to facilitate engagement of the engagement part 26*c* thereto. When the upper unit 2 is initially closed, because the bias arm 26 attached to the upper unit 2 slides on the upper side of the slide rail 29 toward the end portion of the slide rail 29 where the opening 29*b* is provided until the arm edge portion falls in the opening 29*b*, the bias arm 26 can be attached to the slide rail 29 easily. Further, when the upper unit 2 is in a closed state, in which the arm edge portion is at the end portion of the slide rail 29 where the opening 29*b* is located, the torsion spring 27 biases the bias arm 26 downward, that is, the opening 29*b* is located in an area where the bias arm 26 is biased downward. Therefore, the bias arm 26 does not disengage from the slide rail 29 after the bias arm 26 is attached to the slide rail 29.

As described above, the digital image forming apparatus 100 according to the present embodiment includes two types of open-close mechanisms, the first open-close assist members 31L and 31R and the second open-close assist members 32L and 32R. Because these two types of open-close mechanisms share assistance in opening and closing the upper unit 2 with respect to the apparatus body 1, the respective open-close mechanisms can be downsized. Therefore, a space inside a smaller foot-print image forming apparatus can be used effectively, and cost of the components of the respective open-close mechanisms does not increase. Because the first open-close assist members 31L and 31R and the second open-close assist members 32L and 32R are provided directly between the apparatus body 1 and the upper unit 2 without a bracket, etc., used in a typical hinge, the open-close assist mechanism can be simplified with fewer components, thus attaining downsizing and cost reduction.

Further, even when an entire openable body is relatively heavy, by supporting an image reading device (e.g., scanner), an ADF, and a writing unit, as in the present embodiment, a force to open and close the entire openable body can be reduced and operability of an image forming apparatus can be enhanced by using two types of open-close assist mechanisms.

Further, because the openable upper unit 2 supporting the scanner 3, the ADF 4, and the laser writing unit 18 is openable, the upper side of the apparatus body 1 is widely opened, as shown in FIG. 3. Therefore, access to the image forming part 10, etc., located inside of the apparatus body 1 is improved, thus facilitating maintenance work, for example, replacement of process cartridges.

Further, consumables including toner are replaced with the upper unit 2 opened in the present embodiment, and such replacement work is facilitated by reducing the force to open and close the upper unit 2, in an arrangement that is particularly advantageous for replacement of units including a toner container that are frequently replaced. Because the upper unit 2 is easily opened and closed, a force required in such replacement work does not increase even when a scanner and an ADF are provided thereon.

Further, because the upper surface of the exterior cover of the upper unit 2 is used as the discharge tray 22, the image forming apparatus 100 includes fewer components in the present embodiment.

Further, the process cartridges of the image forming part 10 are all-in-one process cartridges in each of which the charger, the developing device, the cleaner, etc., are provided around the photoreceptor drum 11, and are detachably mountable in the apparatus body 1 when the upper unit 2 is opened. Because the upper unit 2 is easily opened and closed and the upper side of the apparatus body 1 is opened widely, an image forming apparatus including process cartridges whose replacement and maintenance work are easy can be provided.

In the present embodiment described above, the second open-close assist members are provided at both sides of the image forming apparatus 100. Alternatively, however, one or more components in one of left and right second open-close assist members may be omitted, depending on configurations of an ADF, a writing part, etc., provided on the upper unit 2, as long as the entire openable body balances. For example, a torsion spring 27 and/or a torque limiter 29 may be omitted at one side, thus reducing the number of components and the cost. In a case in which a torsion spring 27 and/or a torque limiter 29 is provided on only one side, an entire openable body can be balanced by including the torsion spring 27 and/or the torque limiter 29 in a second open-close assist member located at a side close to a center of gravity of the entire openable body.

Further, the force needed to open and close the upper unit 2 (openable body) can be easily adjusted by changing strength (spring force) and/or the number of springs (e.g., the torsion springs 25 and 27, etc.) included in the first open-close assist members 31L and 31R and the second open-close assist member 32L and 32R. Therefore, the force can be set according to specifications of an image forming apparatus, for example, whether to include a scanner, an ADF, etc., and components can be commonly used in different image forming apparatus types, thus reducing a total cost.

As can be appreciated by those skilled in the art, although the present invention is described according to illustrative embodiments, the present invention is not limited thereto, and thus, for example, the configurations and locations of the first and the second open-close assist members are not, limited to that which is described above, provided that the same effect is achieved.

Further, although the rotary shaft of the upper unit 2 (openable body) is located at the back side of the image forming apparatus 100 in the example embodiments described above, alternatively, the rotary shaft may be located at a side so as to extend in the front and back direction thereof.

Further, although the bias arms 26 of the second open-close assist members 32L and 32R are supported by the upper unit 2 and the slide rails 29 thereof are attached to the apparatus body 1 in the example embodiments described above, alternatively, the slide rails 29 may be attached to the upper unit 2 and the bias arms 26, the torsion springs 27, and the torque limiters 28 may be supported by the apparatus body 1.

It is to be noted that, although each of the second open-close assist members 32L and 32R includes both the torsion spring 27 and the torque limiter 28 in the example embodiments described above, alternatively, each of the second open-close assist members 32L and 32R may be configured to include one of the spring 27 and the torque limiter 28.

Further, the bias member used in the second one-close assist members may be torsion bar springs, tension springs, compression springs, etc., not limited to torsion springs (torsion coil spring). Further, components and configurations of the damper mechanism are not limited.

Further, the upper unit 2 may support or include any device. For example, in a case in which an image forming apparatus includes a reading device at its bottom portion, an upper unit does not support the reading device. Further, a scanner and/or an ADF are not necessarily included in an image forming apparatus. A sheet discharge space may be located at an upper surface or a side of an image forming apparatus, not limited to inside its housing. When an image forming apparatus is provided with a scanner and/or an ADF, and a sheet discharge space thereof is located at an upper surface or a side thereof, the scanner and/or the ADF can be supported by an upper unit.

It is to be noted that configurations of respective parts of the image forming apparatus are not limited to the description above. The present invention may be applied to a direct transfer image forming apparatus, not limited to an intermediate transfer image forming apparatus. Further, the present invention may be applied to a monochrome image forming apparatus and an image forming apparatus including a plurality of developing units provided around one photoreceptor. Such image forming apparatuses include copiers, printers, facsimile machines, and multi-function machines including two or more functions thereof.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a first housing;

a rotary shaft attached to the first housing;

a second housing supported by the first housing, configured to open and close with respect to the first housing by rotating around the rotary shaft; and first and second open-close assist members directly attached to the first housing and the second housing, configured to assist opening and closing the second housing, wherein the first and the second open-close assist members share assistance in opening and closing the second housing, and wherein the first open-close assist member is provided at the rotary shaft and the second open-close assist member is provided at a portion other than the rotary shaft.

2. The image forming apparatus of claim 1, further comprising:

an image reading device supported by the second housing; and an automatic document feeder supported by the second housing.

3. The image forming apparatus of claim 1, further comprises an optical writing device supported by the second housing.

4. The image forming apparatus of claim 1, wherein at least one of the first and second open-close assist members biases the second housing in an open direction when the second housing is opened from a closed state, and in a close direction after the second housing passes a predetermined position while rotating in the open direction.

5. The image forming apparatus of claim 1, wherein the second open-close assist member comprises an arm, the arm including:

a first end portion rotatably supported by one of the first and the second housings, a guide rail attached to one of the first and second housings that does not support the first end portion, and a second end portion configured to slidably engage the guide rail.

6. The image forming apparatus of claim 1, wherein the first open-close assist member includes a torsion limiting device attached at an end portion of the rotary shaft.

7. The image forming apparatus of claim 1, wherein the second open-close assist member includes an arm and a torque limiter is attached to the arm to limit rotation of the second housing.

8. An image forming apparatus, comprising:

a first housing;

a rotary shaft attached to the first housing;

a second housing supported by the first housing, configured to open and close with respect to the first housing by rotating around the rotary shaft; and first and second open-close assist members directly attached to the first housing and the second housing, configured to assist opening and closing the second housing, wherein the first and the second open-close assist members share assistance in opening and closing the second housing, and wherein at least one of the first and the second open-close assist members biases the second housing in an open direction when the second housing is opened from a closed state, and in a close direction after the second housing passes a predetermined position while rotating in the open direction.

9. The image forming apparatus of claim 8, wherein the second open-close assist member comprises an arm, the arm including:

a first end portion rotatably supported by one of the first and the second housings, a guide rail attached to one of the first and second housings that does not support the first end portion, and a second end portion configured to slidably engage the guide rail.

10. The image forming apparatus of claim 8, wherein the first open-close assist member includes a torsion limiting device attached at an end portion of the rotary shaft.

11. The image forming apparatus of claim 8, wherein the second open-close assist member includes an arm and a torque limiter is attached to the arm to limit rotation of the second housing.

12. An image forming apparatus, comprising:

a first housing;

a rotary shaft attached to the first housing;

a second housing supported by the first housing, configured to open and close with respect to the first housing by rotating around the rotary shaft; and first and second open-close assist members directly attached to the first housing and the second housing, configured to assist opening and closing the second housing, wherein the first and the second open-close assist members share assistance in opening and closing the second housing, and wherein the second open-close member comprises an arm, the arm including a first end portion rotatably supported by one of the first and the second housings, a guide rail attached to one of the first and the second housings that does not support the first end portion, and a second end portion configured to slidably engage the guide rail.

13. The image forming apparatus of claim 12, wherein the second open-close member is configured to prevent the second end portion of the arm from disengaging from the guide rail.

14. The image forming apparatus of claim 12, wherein the guide rail comprises an opening to engage the second end portion of the arm therewith.

15. The image forming apparatus of claim 12, wherein the second open-close assist member further comprises a torsion spring configured to bias the second end portion of the arm to the guide rail.

16. The image forming apparatus of claim 12, wherein the second open-close assist member further comprises a torque limiter to absorb a rotation torque of the second housing.

17. The image forming apparatus of claim 12, wherein the guide rail further comprises an elastic member at an end portion thereof that is at a rotary shaft side.

18. The image forming apparatus of claim 12, wherein the first open-close assist member includes a torsion limiting device attached at an end portion of the rotary shaft.

19. The image forming apparatus of claim 12, wherein the second open-close assist member includes a torque limiter attached to the arm to limit rotation of the second housing.

* * * * *